United States Patent [19]

Gut et al.

[11] Patent Number: 4,657,588

[45] Date of Patent: Apr. 14, 1987

[54] METHOD OF KEEPING INDUCTOR SPOUTS, DOWNGATES AND OUTLET CHANNELS FREE OF DEPOSITS IN CONNECTION WITH A CAST IRON MELT

[75] Inventors: Karl Gut, Benken; Ivo Henych, Stetten, both of Switzerland

[73] Assignee: Georg Fischer Aktiengesellschaft, Schaffhausen, Switzerland

[21] Appl. No.: 828,958

[22] Filed: Feb. 12, 1986

[30] Foreign Application Priority Data

Feb. 14, 1985 [CH] Switzerland ..... 679/85

[51] Int. Cl.[4] ..... C22C 33/08

[52] U.S. Cl. ..... 420/20; 420/18

[58] Field of Search ..... 75/130 R, 130 B

[56] References Cited

U.S. PATENT DOCUMENTS 3,998,625 12/1976 Koros ..... 75/53

4,230,490 10/1980 Kessl ..... 75/130 B 4,415,362 11/1983 Archenholtz ..... 75/130 B

*Primary Examiner*—Peter D. Rosenberg

*Attorney, Agent, or Firm*—Toren, McGeady and Goldberg

[57] ABSTRACT

A method of keeping inductor spouts, downgates and outlet casting channels and the like free of deposits during the production of a cast iron melt involves treatment with pure magnesium. Such deposits, which occur as reaction products and block the channels causing considerable maintenance expense, are prevented by the use of pure magnesium. The cast iron melt is flushed free of suspended highly basic reaction products, such as MgO, CaO, $Al_2O_3$, FeO and MgS, in a predetermined magnesium treatment of the cast iron melt with pure magnesium by a simultaneous evaporation of magnesium not consumed in the magnesium treatment. By preventing the formation of deposits, the life of the vessel used is increased and maintenance costs are decreased.

8 Claims, No Drawings

METHOD OF KEEPING INDUCTOR SPOUTS, DOWNGATES AND OUTLET CHANNELS FREE OF DEPOSITS IN CONNECTION WITH A CAST IRON MELT

BACKGROUND OF THE INVENTION

The present invention is directed to a method of keeping inductor spouts, downgates or ingates, and outlet channels or pouring spouts and the like free of deposits while a cast iron melt is treated with pure magnesium in a casting process. The method is used for the production of cast iron with spheroidal or nodular graphite or vermicular graphite. The invention also includes the vessels for carrying out the method.

The conversion of an iron melt into cast iron with nodular or spheroidal graphite or into cast iron with vermicular graphite is achieved by treating the melt with magnesium or rare earth metals such as Ce, Ba, Ca or the like. It is known that magnesium has a high vapour pressure, low melting and boiling temperatures and a low specific gravity. Such characteristics lead to the use of magnesium, as a rule, as a preliminary or master alloy, such as FeSiMg with low Mg content. The magnesium content can vary between 5–30 percent by weight. The use of pure magnesium is possible only in special devices such as the pure magnesium converter.

It is also known that magnesium has a high affinity for oxygen and sulfur. Because of these characteristics and the low solubility of magnesium in the melt, the modifying action of magnesium on the graphite structure is effective only for a limited time period. Accordingly, magnesium is consumed by the reaction with the sulfur present in the melt, by oxidation due to oxygen in the atmosphere, as well as by reduction of the oxides present in the iron, in the slag and in the refractory materials contacting the melt. Therefore, a significant portion of the magnesium introduced into the melt is ineffective for the modification of the graphite. To slow down these reactions (so-called "fading") and to reduce the temperature loss of the melt, a channel type pressure furnace with an inert gas atmosphere was developed. Such a furnace is generally used as a temperature holding casting furnace.

In such a furnace, the fading effect caused by atmospheric oxygen and by evaporation of the magnesium is substantially reduced by the action of inert gas on the melt surface.

The use of master alloys contributes to a reduction of the magnesium activity. Other elements such as Fe, Si, Ni and the like are mixed with the melt. Accordingly, the reaction speed is reduced and the reaction between magnesium and sulfur is also slowed down with the result that the sulfur content cannot be substantially reduced. Thus, the degree of desulfurization is low and the reaction between free sulfur and magnesium is continued after the treatment whereby there is a quick reduction in the active magnesium content in the melt (fading). This process is not influenced by the presence of an inert gas atmosphere.

Treatments with a master alloy based on FeSi develop acid reaction slags containing more than 60% of oxides which are easily reducible by means of magnesium, such as FeO, MnO, and $SiO_2$. Even after removal of the reaction slag from the surface of the melt, a certain portion of the easily reducible oxides remains suspended in the melt. Accordingly, the reaction, that is, oxidation, Mg+S and the like is continued, and additional reaction products are formed.

In addition to acceleration of magnesium fading, the slag also deposits or settles out at certain places in the furnace and causes operational problems, such as blockages in the inlet and outlet casting channels and inductors spouts. Such deposits lead to considerable furnace maintenance costs, a rapid decay of the magnesium and a decrease in the lifetime of the furnace lining.

SUMMARY OF THE INVENTION

Therefore, it is the primary object of the present invention to provide a method for eliminating all of the disadvantages mentioned above. In particular, the fading of magnesium-content is slowed down, the furnace maintenance is simplified and the lifetime of the furnace lining is increased.

In accordance with the present invention, the cast iron melt is treated with pure magnesium and the excessive magnesium of the treatment is evaporated so that the cast iron melt is rinsed or cleansed free of suspended highly basic reaction products, such as MgO, CaO, $Al_2O_3$, FeO, MgS.

It is proposed, in accordance with the invention, to treat a base iron with pure magnesium. As a result, a very high degree of desulfurization is obtained by the high magnesium activity (100% magnesium) with a residual sulfur content of approximately 0.005%. The reaction products are almost completely separated out due to the intensive agitating effect of the magnesium which evaporates at the base of the melt. The few remaining reaction products are distinguished by a high basicity with only small amounts of easily reducible oxides, such as $SiO_2$, FeO and the like. Such a melt behaves advantageously during holding temperature, since the separation of slag products does not occur and the magnesium content remains constant from the start. Accordingly, magnesium loss is minimal and, when the furnaces are well sealed, the iron remains usable for a longer time.

A very slight decay of magnesium can be attained, in the range between 0.003 and 0.005 percent by weight/h, by means of the extremely low residual sulfur content of the melt and the highly basic reaction products which contain virtually no oxides that are easily reducible by magnesium.

An exact adjustment of the residual magnesium content and the casting temperature is easily attained.

The life of the refractory lining of the upper furnace can be considerably increased in this manner as can that of the inductor spouts.

DETAILED DESCRIPTION OF THE INVENTION

The following examples illustrate the method embodying the present invention.

Example 1

In a system with a 5 t converter and 16 t holding casting furnace with a protective gas atmosphere of $N_2$, 120,000 t of iron were processed. The initial sulfur quantity of the melt was 0.10% by weight. After treatment in the converter with two kg magnesium/t, a residual magnesium content of 0.045–0.055 percent by weight was measured, and the final sulfur content was 0.004–0.006 percent. Magnesium fading of 0.004 percent per hour was determined. The slag removed from the furnace corresponded to 50 kg per day, that is, approximately 0.13 kg/t iron. The life of the refractory lining of the upper furnace could be increased to two years, and that of the inductor to one year.

Example 2

In a system with a 3.5 t converter and a 10 t holding casting furnace with a protective gas atmosphere of $N_2$, the following values were measured with a throughput of 20,000 t: residual magnesium content=0.045–0.050 percent, final sulfur content=0.004 percent.

The lifetime of the refractory lining was one year, and the magnesium fading was 0.004%/h. Treatment was effected in the converter with 1.2 kg Mg/t.

Example 3

In a system with a 2 t converter and an 8 t holding casting furnace, cast iron with vermicular graphite was produced. The residual magnesium content in the furnace was 0.015–0.040 percent. Innoculation was effected with 0.015% sulfur in the form of FeS into the liquid metal stream. The cast iron with vermicular graphite showed a more than 80% portion of vermicular graphite form.

While specific embodiment of the invention have been shown and described in detail to illustrate the application of the inventive principles, it will be understood that the invention may be embodied otherwise without departing from such principles.

We claim:

1. Method of keeping inductor spouts, downgates and outlet casting channels free of deposits in the production of cast iron melt treated with magnesium in a casting process, comprising the steps of using a predetermined amount of pure magnesium for a magnesium treatment of the cast iron melt for effecting a very high degree of desulfurization with a residual sulfur content of approximately 0.005% and providing pure magnesium in addition to the predetermined amount not required for the desulfurization and utilizing the additional magnesium for rinsing and cleansing suspended highly basic reaction products from the cast iron melt.

2. Method, as set forth in claim 1, carrying out the magnesium treatment and the rinsing or cleansing in the same vessel.

3. Method, as set forth in claim 1 or 2, wherein carrying out the magnesium treatment and the rinsing or cleansing with the same stored amount of pure magnesium.

4. Method, as set forth in claim 1 or 2, including the step of producing cast iron with spheroidal or nodular graphite with a residual Mg content of 0.025–0.080 percent by weight.

5. Method, as set forth in claim 1 or 2, for producing cast iron with vermicular graphite having a residual Mg content of 0.010–0.060 percent by weight.

6. Method, as set forth in claim 1 or 2, including the step of carrying out a continuous casting process.

7. Method, as set forth in claim 1 or 2, including the step of carrying out the method in a converter.

8. Method, as set forth in claim 1 or 2, carrying out the method in a converter with a channel pressure furnace connected to the converter.

* * * * *